US007201161B1

(12) United States Patent
York

(10) Patent No.: US 7,201,161 B1
(45) Date of Patent: Apr. 10, 2007

(54) COMPOUND SPRING-LOADED ARCHERY BOW

(76) Inventor: Merineth S. York, 2023 E. Hermosa Vista Dr., Mesa, AZ (US) 85213

( * ) Notice: Subject to any disclaimer, the term of this patent is extended or adjusted under 35 U.S.C. 154(b) by 0 days.

(21) Appl. No.: 11/183,653

(22) Filed: Jul. 18, 2005

(51) Int. Cl.
*F41B 5/00* (2006.01)

(52) U.S. Cl. ..... 124/16; 124/23.1; 124/25.6

(58) Field of Classification Search ..... 124/16, 124/23.1, 25.6, 86, 88
See application file for complete search history.

(56) References Cited

U.S. PATENT DOCUMENTS

| | | | | |
|---|---|---|---|---|
| 428,912 | A * | 5/1890 | Holmes | 124/23.1 |
| 1,346,754 | A | 7/1920 | Jones | |
| 2,714,377 | A | 8/1955 | Mulkey | |
| 3,552,373 | A | 1/1971 | Van Hecke | |
| 3,989,026 | A | 11/1976 | Nishioka | |
| 4,041,927 | A | 8/1977 | Van House | |
| 4,458,657 | A | 7/1984 | Stockmar | |
| 4,756,295 | A | 7/1988 | Guzzetta | |
| 4,803,970 | A | 2/1989 | Mattheck et al. | |
| 5,353,777 | A | 10/1994 | Fincher | |
| 5,638,804 | A | 6/1997 | Remick et al. | |
| 6,698,413 | B1 | 3/2004 | Ecklund | |

* cited by examiner

*Primary Examiner*—John A. Ricci
(74) *Attorney, Agent, or Firm*—John D. Lister

(57) ABSTRACT

A compound spring-loaded archery bow, which retains the appearance of a traditional bow, has a rigid bow frame that is formed by a central riser with a handgrip and arrow rest, an upper limb extending upward from the central riser and a lower limb extending downward from the central riser. Cam mechanisms are mounted at the upper end of the upper limb and the lower end of the lower limb and a bowstring is secured to and extends between the upper and lower cam mechanisms. When the bowstring is drawn from an initial preset position to shoot an arrow, there is a synchronized actuation of the upper and lower cam mechanisms. The upper and lower limbs are tubular and contain separate upper and lower spring assemblies for applying tension to the bowstring through the cam mechanisms only when the bowstring is drawn from its initial preset position. The degree of initial compression of the springs in the upper and lower spring assemblies can be independently adjusted to adjust the magnitude of the forces exerted on the bowstring by the assemblies when the bowstring is drawn to thereby set the maximum drawing force for the bowstring and the relative forces exerted on the bowstring by the assemblies.

17 Claims, 4 Drawing Sheets

50
44
36
46
78
78
92
84
90
86
24
82
62
60
64
68
58
70
52
90
76
74
38
66
88
62
54
94
56
84
106
106
102
35
32
35
104
34
33
98
104
22
96
100

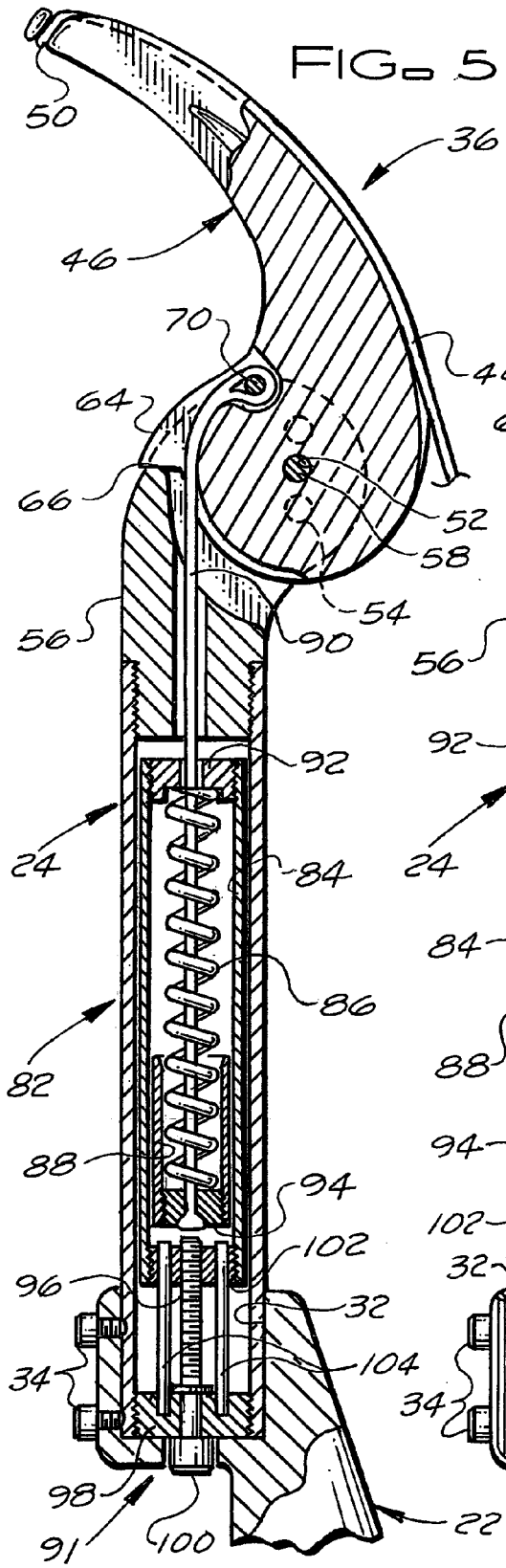
FIG. 5
50
36
46
70
44
64
66
52
58
54
56
90
92
24
84
86
82
88
94
102
96
32
104
34
98
91
100
22
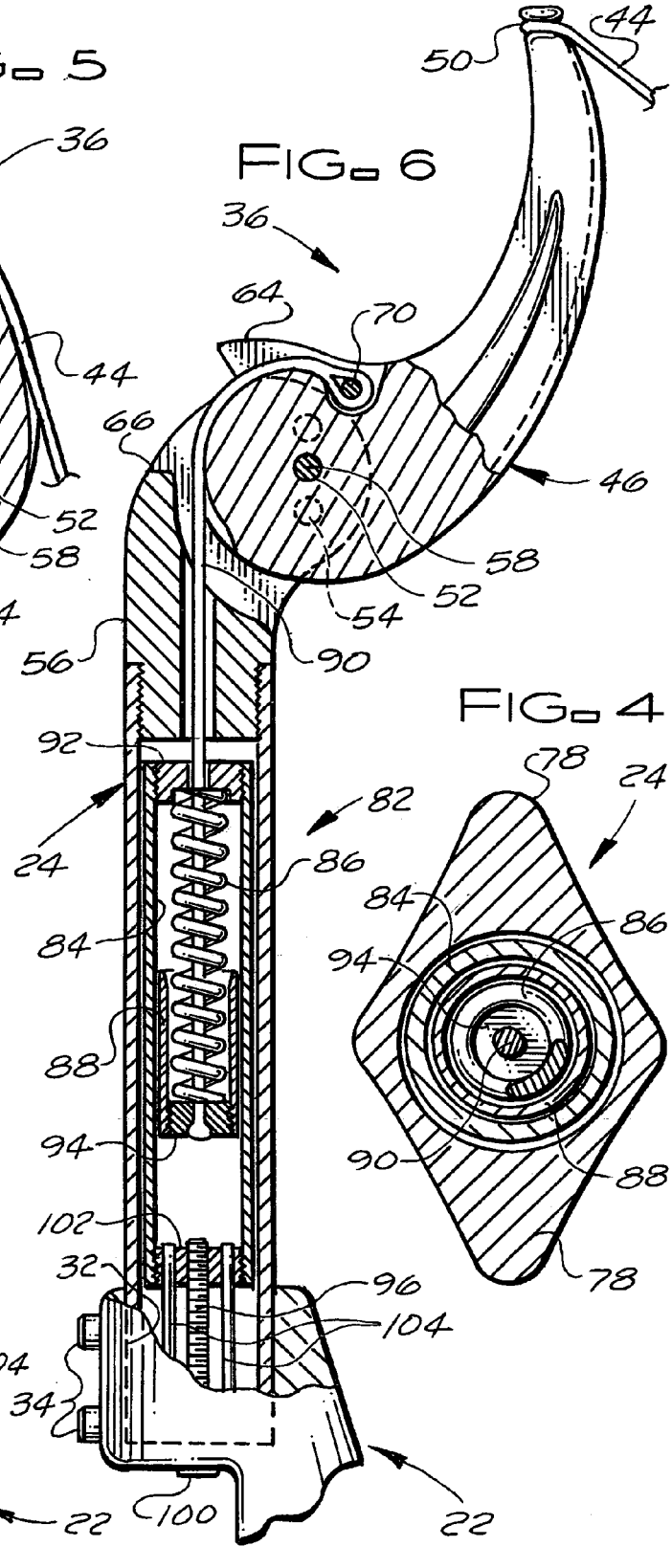
FIG. 6
50
44
36
64
70
66
46
58
52
54
56
90
92
24
82
86
84
88
94
102
32
96
104
34
100
22
FIG. 4
78
24
84
86
94
90
88
78

COMPOUND SPRING-LOADED ARCHERY BOW

BACKGROUND OF THE INVENTION

The subject invention relates to a compound spring-loaded archery bow and in particular to an improved compound spring-loaded archery bow with improved separate upper and lower spring tensioning assemblies and associated cam mechanisms for applying tension to the bowstring of the bow. The separate upper and lower spring tensioning assemblies are contained within the upper and lower rigid limbs of the bow so that the bow of the subject invention retains the appearance of a traditional archery bow while having the advantages of being a compound spring-loaded archery bow.

A traditional archery bow has a central riser with a handgrip and arrow rest plus upper and lower resilient limbs that extend upward and downward from the central riser and provide the archery bow with its traditional appearance. The central riser and upper and lower resilient limbs of the archery bow form a leaf spring. A bowstring is attached to the free ends of the upper and lower resilient limbs and as the bowstring is drawn back from its initial position by an archer to shoot an arrow the upper and lower resilient limbs flex to place the bowstring under tension. The farther the archer draws back the bowstring, the more the upper and lower resilient limbs of the bow are flexed to impart ever greater tension to the bowstring. When the bowstring is released to shoot the arrow, the upper and lower resilient limbs of the archery bow snap back to their original positions and thereby snap the bowstring back to its initial position to propel the arrow toward a selected target. While current traditional archery bows are frequently made of strong composite materials, the upper and lower resilient limbs of these bows sometimes fail and can cause serious injury. Traditional archery bows have other drawbacks. The frames of these traditional archery bows have a unitary construction so that these bows cannot be disassembled for compact storage, handling, and transport. These archery bows are manufactured to have a maximum drawing force that can not be changed with the maximum drawing force typically being set to be within a limited 10 pound range, e.g. within a 40 to 50 pound maximum pull range, within a 50 to 60 pound maximum pull range, within a 60 to 70 pound maximum pull range, etc. Thus, once an archer selects a traditional archery bow, the archer is restricted with that bow to a set maximum drawing force that is within the limited poundage range of that bow and must obtain another bow or bow limbs should he/she desire for whatever reason to utilize an archery bow having a maximum drawing force within a greater or lesser poundage range.

Compound archery bows such as the compound archery bows disclosed in U.S. Pat. No. 4,458,657, issued Jul. 10, 1984 and U.S. Pat. No. 6,698,413 are examples of compound bows that have been developed as an alternative to the traditional "leaf spring" archery bow discussed above. The compound archery bow of the '657 patent has a somewhat complicated structure with both a main frame and a handle grip and bowstring tensioning assembly located forward of the main frame. The bowstring tensioning assembly is formed by exposed resilient tubes for tensioning the bowstring, which are stretched and placed in tension when the bowstring of the bow is drawn. The exposed resilient tensioning tubes of the tensioning assembly are mounted on forward projecting wings of the bow's handle grip and are connected to cam members of the bow which, in turn, are connected to the bowstring. The compound archery bow of the '413 patent is another example of a compound archery bow. This compound archery bow only utilizes a single compressible coil spring bowstring tensioning unit which is threaded into and projects forward from a lower limb of the bow. This form of tensioning unit only permits the tension on the bowstring to be adjusted from the lower end of the bowstring and compromises the configuration of the bow so that the bow doesn't have the appearance of a traditional archery bow. Thus, while compound archery bows such as those just discussed are available, there has remained a need for an improved compound archery bow with independent upper and lower bowstring tensioning assemblies that permit the performance characteristics of the bow to be easily and accurately tuned for optimum performance and that enable the compound archery bow to retain the configuration of a traditional archery bow.

SUMMARY OF THE INVENTION

The compound spring-loaded archery bow of the subject invention provides an improved compound spring-loaded archery bow to solve the problems of the prior art. The compound spring-loaded archery bow of the subject invention has improved independent upper and lower bowstring coil spring tensioning assemblies that permit the performance characteristics of the bow to be easily and accurately tuned for optimum performance. The nock point on a bowstring where the arrow is positioned when being shot from the bow is typically located off center (i.e. rather than having the nock point of the bowstring located equidistant from the upper and lower ends of the bowstring where the bowstring is attached to cam members of the bow, the nock point is located closer to one end of the bowstring than the other end of the bow string). With the nock point on the bowstring typically being located off center, the ability of the compound spring-loaded archery bow of the subject invention to be easily adjusted to independently adjust the poundage exerted on the upper and lower ends of the bowstring to place the bowstring in tension is even more important to enable the bow to be easily and accurately tuned for optimum performance. The use of the upper and lower independent coil spring tensioning assemblies of the compound spring-loaded archery bow of the subject invention further enhances the performance of the compound spring-loaded archery bow of the subject invention by enabling the poundage exerted on the bowstring by the independent coil spring tensioning assemblies to be easily and accurately set and once set at a desired poundage, by maintaining the poundage settings to ensure the continued optimum performance in service of the compound spring-loaded archery bow of the subject invention. In addition to the above, the coil spring tensioning assemblies of the compound spring-loaded archery bow of the subject invention are contained within the upper and lower limbs of the bow frame so that the compound spring-loaded archery bow of the subject invention retains the appearance of a traditional archery bow and in a preferred embodiment of the bow, the bow is easy to disassemble for compact storage, handling, and transport.

The compound spring-loaded archery bow of the subject invention includes a central riser with a handgrip and arrow rest and rigid upper and lower limbs. The upper limb extends upward from the central riser and the lower limb extends downward from the central riser to form a rigid bow frame with the configuration of a traditional archery bow. The rigid upper and lower limbs of the compound spring-loaded archery bow of the subject invention are hollow tubes that contain the coil spring tensioning assemblies for tensioning the bowstring. These coil spring tensioning assemblies are connected to top and bottom limb cam assemblies located, respectively, at the free top end portion of the upper limb and the free bottom end portion of the lower limb. The bowstring is also secured to and extends between the limb cam assemblies at the top and bottom of the compound spring-loaded archery bow. When the bowstring is drawn, the bow poundage coil springs of the coil spring tensioning assemblies contained within the upper and lower limbs are compressed placing the bowstring under increasing tension as the bowstring is drawn. When the archer releases the bowstring, the bow poundage coil springs of the coil spring tensioning assemblies in the upper and lower limbs rapidly expand and snap the bowstring rapidly back to its initial undrawn position to accurately propel an arrow from the bow.

With the structure of the coil spring tensioning assemblies of the subject invention and their location within the rigid upper and lower limbs of the rigid bow frame, when the bowstring of the compound spring-loaded archery bow of the subject invention is released by the archer, the kinetic energy developed by the coil springs of the upper and lower coil spring tensioning assemblies, as the coil springs of these assemblies rapidly expand, is released in the directions of the longitudinal axes of the rigid upper and lower limbs of the rigid bow frame. It is believed that this structure and this location of the coil spring tensioning assemblies of the subject invention causes the kinetic energy released by the upper and lower coil spring tensioning assemblies, initiated by the release of the bowstring when shooting an arrow, to cancel each other out and eliminate or substantially eliminate vibrations that would otherwise be set up in the bow to adversely affect the flight of the arrow as the arrow leaves the bow after the bowstring is released by the archer.

In a preferred embodiment of the invention, each coil spring tensioning assembly of the compound spring-loaded archery bow includes a tubular spring housing that is slidably housed within one of the hollow limbs of the bow. Each tubular spring housing has first and second ends with the first end of each tubular spring housing facing the cam assembly end of the limb and a second end of each tubular spring housing facing the riser end of the limb. A spring compression member is slidably housed within the tubular spring housing of each coil spring tensioning assembly and the bow poundage coil spring of the coil spring tensioning assembly extends between and abuts a spring end abutment at the first end of the tubular spring housing and a spring end abutment of the spring compression member. Preferably, the spring compression member is a tubular spring compression member that has a spring end abutment at one end and partially houses the bow poundage coil spring of the coil spring tensioning assembly. A spring cable is attached at a first end to the limb cam assembly associated with the coil spring tensioning assembly and at a second end to the spring compression member so that when the bowstring of the compound spring-loaded archery bow is drawn, the bow poundage coil spring of the coil spring tensioning assembly is compressed by the spring compression member and tension on the bowstring is increased.

Each coil spring tensioning assembly has an adjustment mechanism associated with the second end of the tubular spring housing of the coil spring tensioning assembly for changing the degree of pre-compression of the bow poundage coil spring of the coil spring tensioning assembly to thereby raise or lower the forces exerted by the bow poundage coil spring on the spring cable and through the spring cable and associated cam assembly, the forces exerted by the coil spring tensioning assembly on the bowstring that apply increasing tension to the bowstring as the bowstring is drawn back in the act of shooting an arrow. In a preferred embodiment of the subject invention, the adjustment mechanism of each coil spring tensioning assembly includes a threaded rod that is rotatably held in a threaded end cap of the limb with which the coil spring tensioning assembly is associated so that the threaded rod does not move axially when turned. One end of the threaded rod is threaded into a threaded hole in the second end of the tubular spring housing so that when the threaded rod is turned, the tubular spring housing is moved axially within the hollow limb. Since the bow poundage coil spring has one end abutting the spring end abutment at the first end of the tubular spring housing and the other end abutting the spring end abutment of the spring compression member, the axial movement of the tubular spring housing within the limb changes the degree of pre-compression of the bow poundage coil spring to raise or lower the forces exerted by the bow poundage coil spring on the spring cable and through the spring cable and associated cam assembly, the forces exerted on the bowstring by the coil spring tensioning assembly that apply increasing tension to the bowstring as the bowstring is drawn back in the act of shooting an arrow.

BRIEF DESCRIPTION OF THE DRAWINGS

FIG. 4 is a transverse cross section through the rigid upper limb and the upper coil spring tensioning assembly of the compound spring-loaded archery bow of FIG. 1.

FIG. 5 is a vertical section of the rigid upper limb, the upper coil spring tensioning assembly, and the upper cam assembly of the compound spring-loaded archery bow of FIG. 1 with the bow poundage compression coil spring of the upper coil spring tensioning assembly compressed a selected degree to an initial compression setting.

FIG. 6 is a vertical section of the rigid upper limb, the upper coil spring tensioning assembly, and the upper cam assembly of the compound spring-loaded archery bow of FIG. 1 with the bow poundage compression coil spring of the upper coil spring tensioning assembly shown compressed from the initial compression setting shown in FIG. 5 as a result of the bowstring being fully drawn or substantially fully drawn.

DESCRIPTION OF THE PREFERRED EMBODIMENTS

Figures 1, 2:
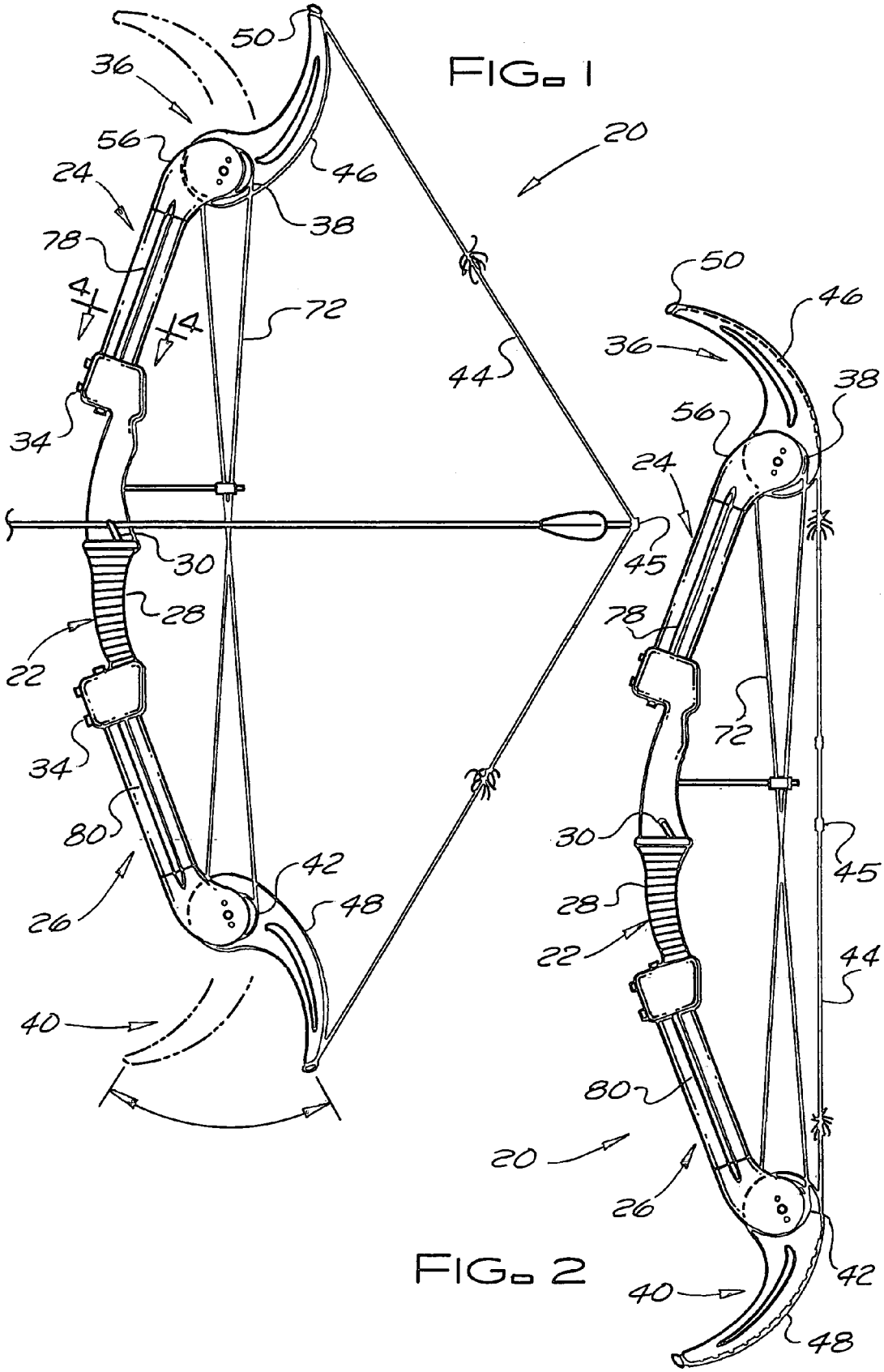
FIG. 1 is a side view in elevation of a preferred embodiment of the compound spring-loaded archery bow of the subject invention with an arrow loaded into the bow and the bowstring substantially fully drawn or fully drawn.
FIG. 2 is a side view in elevation of the compound spring-loaded archery bow of FIG. 1 with the bowstring in its initial undrawn position.

As shown in FIGS. 1 and 2, the compound spring-loaded archery bow 20 of the subject invention has a rigid bow frame that includes a rigid central riser 22, a rigid upper limb 24, and a rigid lower limb 26. The rigid central riser 22 had a handgrip 28 and an arrow rest 30. The rigid upper limb 24 extends upward from an upper end portion of the central riser 22, the rigid lower limb 26 extends downward from a lower end portion of the central riser 22, and the compound spring-loaded archery bow 20 has the appearance of a traditional archery bow.

Preferably, the rigid upper limb 24 and the rigid lower limb 26 are detachably secured to the central riser 22 so that the compound spring-loaded archery bow 20 can be easily disassembled for compact storage, handling, and transport. In a preferred embodiment of the subject invention the upper end portion and the lower end portion of the rigid central riser 22 have sockets 32 for receiving the lower end portion of the rigid upper limb 24 and the upper end portion of the rigid lower limb 26. The upper socket 32 at the upper end portion of the rigid central riser 22 for receiving the lower end portion of the rigid upper limb 24 is shown in greater detail in FIGS. 5 to 7. The outer transverse cross sectional configuration of the lower end portion of the upper rigid limb 24 is the same or substantially the same as the inner transverse cross sectional configuration of the upper socket 32. The lower end portion of the rigid upper limb 24 is slidably received within the socket 32 in a tight sliding fit and is secured in place within the upper socket 32 by the securing bolts 34. Preferably, the lower end portion of the upper limb 24 and the upper socket 32 have a rib and groove arrangement for assuring that the upper limb 24 is properly oriented in the upper socket when the bow 20 is assembled. In the embodiment shown in FIG. 3, the lower end portion of the upper limb 24 has a pair of diametrically opposed ribs 33 (only one of which is shown) that extend parallel to the longitudinal axis of the upper limb 24 and these ribs 33 are slidably received in a tight sliding fit within a pair of diametrically opposed, longitudinally extending slots 35 in the upper socket 32. While in the embodiment shown, the ribs are located on the lower end portion of the upper limb 24 and the slots are formed in the upper socket 32, the ribs may be located in the upper socket 32 and the slots formed in the lower end portion of the upper limb 24. The lower socket 32 at the lower end portion the rigid central riser 22 and the upper end portion of the rigid lower limb 26 have the same structures as the upper socket 32 and the lower end portion of the rigid upper limb 24. To disassemble or "breakdown" the compound spring-loaded archery bow 20 into separate rigid central riser 22, rigid upper limb 24, and rigid lower limb 26 components for compact storage, handling and transport, the securing bolts 34 of the upper and lower sockets 32 merely have to be loosened and the rigid upper and lower limbs 24 and 26 slid out of the upper and lower sockets 32.

As shown in FIGS. 1 and 2, an upper cam assembly 36 and upper synchronizing wheels 38 of a cam synchronizing mechanism are mounted on an upper end portion of the rigid upper limb 24 and a lower cam assembly 40 and lower synchronizing wheels 42 of the cam synchronizing mechanism are mounted on a lower end portion of the rigid lower limb 26. An upper end of a bowstring 44 is secured to a cam member 46 of the upper cam assembly 36 and a lower end of the bowstring 44 is secured to a cam member 48 of the lower cam assembly 40. As shown in FIGS. 1 and 2, the bowstring typically has an off-center nock point 45, a conventional peep sight above the nock point, and conventional string silencers above and below the nock point.

The upper cam assembly 36 and the upper synchronizing wheels 38 of the cam synchronizing assembly have the same structure as the lower cam assembly 40 and the lower synchronizing wheels 42 of the cam synchronizing assembly and function in the same way. Accordingly, the following detailed description of the upper cam assembly 36 and the upper synchronizing wheels 38 of the cam synchronizing assembly applies to the lower cam assembly 40 and the lower synchronizing wheels 42 of the cam synchronizing assembly.

Figure 3:
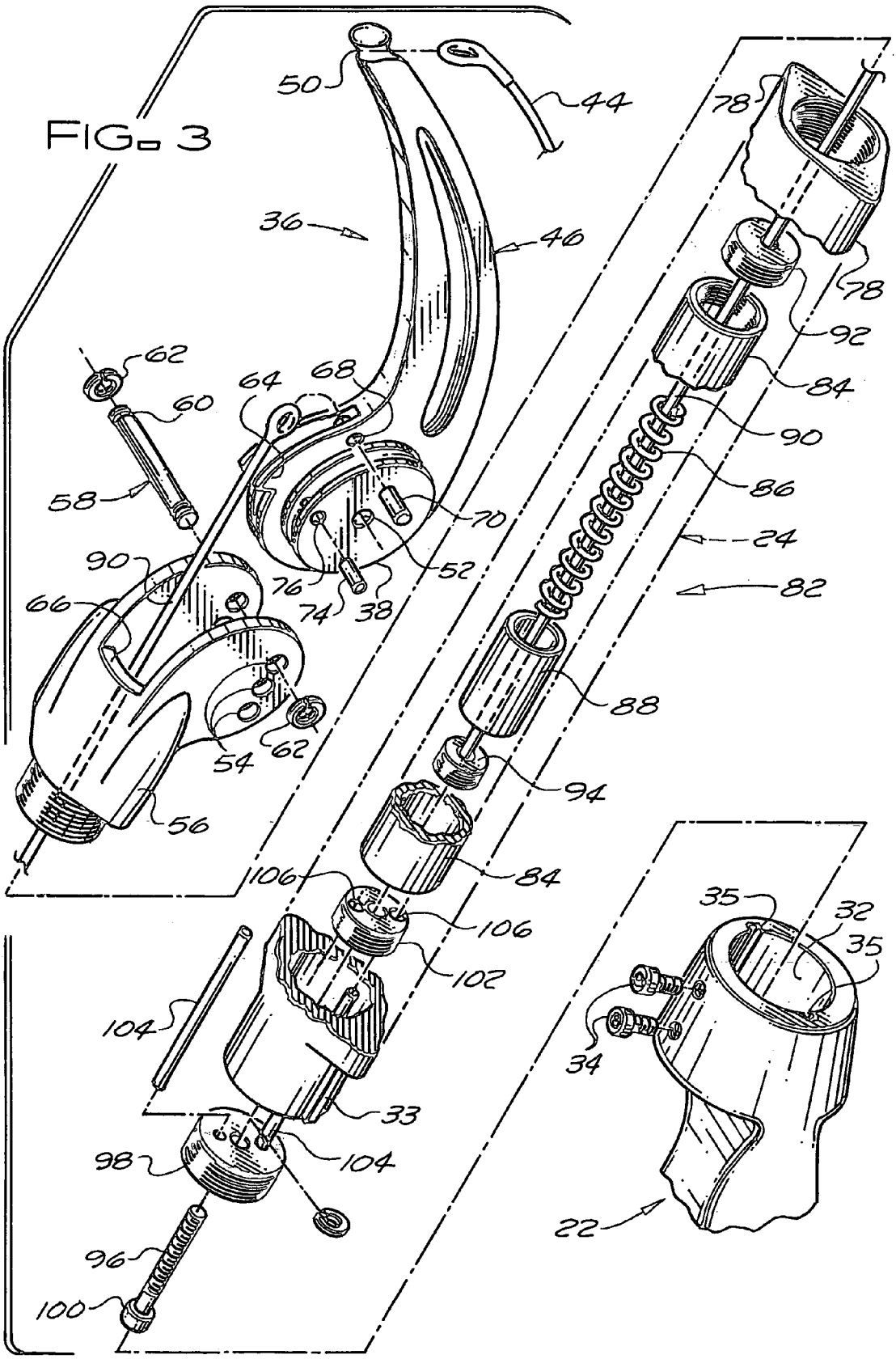
FIG. 3 is an exploded perspective view of the rigid upper limb and the upper coil spring tensioning assembly of the compound spring-loaded archery bow of FIG. 1 with portions of the upper limb and upper coil spring tensioning assembly in phantom line.

The upper cam assembly 36 includes the upper cam member 46 (which as shown is a reverse curve limb cam with a bowstring retainer 50 at its outer free end); a mounting pin hole 52 that passes transversely through a base of the upper cam member 46 for receiving a mounting pin, a series of pairs of aligned mounting pin holes 54 in an upper mounting yoke member 56 of the rigid upper limb 24 for receiving a mounting pin; and a mounting pin 58. The cam member 46 is pivotally mounted in the upper mounting yoke member 56 of the rigid upper limb 24 by locating the base of the upper cam member 46 between the arms of the upper mounting yoke member 56, passing the mounting pin 58 through a selected pair of the aligned mounting pin holes 54 in the upper mounting yoke member 56 and the mounting pin hole 52 in the base of the upper cam member 46, and securing the mounting pin 58 in place (e.g. securing the mounting pin 58 in place by the use of annular pin grooves 60 in the end portions of the mounting pin and resilient locking rings 62, as shown in FIG. 3). As shown in phantom line in FIG. 7, the length of the bowstring draw for the bowstring 44 for the compound spring-loaded archery bow 20 can be adjusted (lengthened or shortened) by using different pairs of the mounting pin holes 54 in the upper mounting yoke member 56 to pivotally mount the upper cam member 46 in the upper mounting yoke member 56.

The base of the upper cam member 46 has a first cam stop member 64 and the upper mounting yoke member 56 has a second cam stop member 66 that engage and cooperate with each other to limit (as shown in FIGS. 5 and 6) the counterclockwise pivotal movement of the upper cam member 46 in the upper mounting yoke member 56. The base of the upper cam member 46 also includes an arcuate groove for receiving an upper end portion of a tensioning cable of an upper coil spring tensioning assembly housed within the rigid upper limb 24 and a tensioning cable retaining mechanism for securing the upper end of the tensioning cable of the upper coil spring tensioning assembly. As shown in FIGS. 3, 5 and 6, the arcuate groove in the base of the upper cam member 46 is formed by a pair of spaced apart arcuate flanges and the tensioning cable retaining mechanism is formed by a pair of aligned retaining pin holes 68 passing through these arcuate flanges and a retaining pin 70 that is secured within the retaining pin holes 68. While the upper cam member 46 shown is a reverse curve limb cam, it is contemplated other cam members 46 and 48 can be used on the compound spring-loaded archery bow 20, such as but not limited to wheel cams and hatchet cams.

Figure 8:
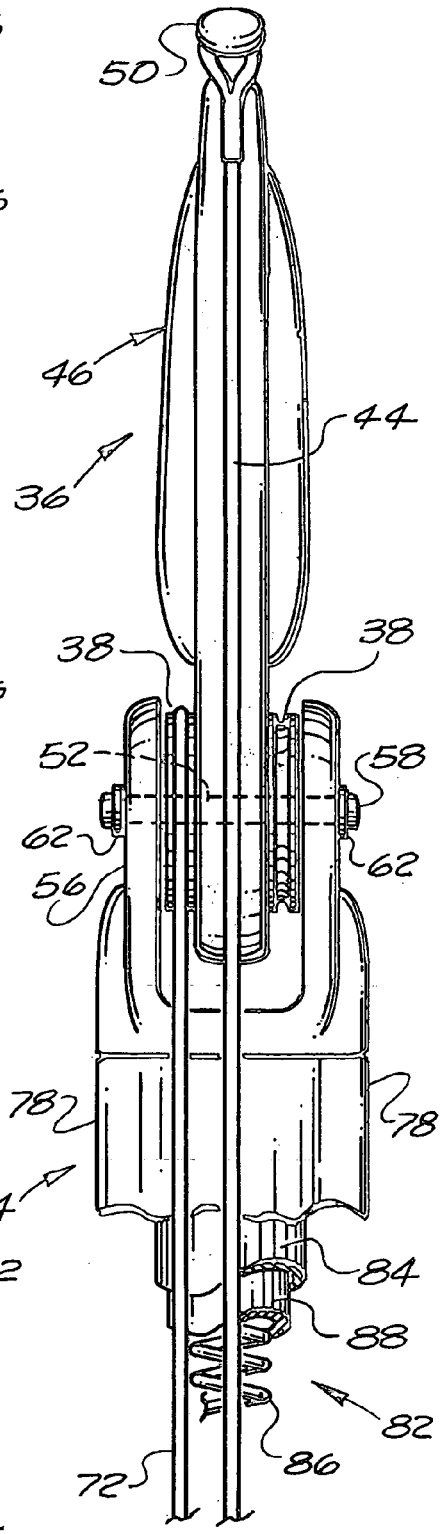
FIG. 8 is a partial front view in elevation of the compound spring-loaded archery bow of FIG. 1.

As best shown in FIGS. 3 and 8, the upper synchronizing wheels 38 are located on each side of the base of the upper cam member 46 and the mounting pin hole 52 of the upper cam member 46 also passes through the centers of the upper synchronizing wheels 38. With this structure, the mounting pin 58 also pivotally mounts the upper synchronizing wheels 38 in the upper mounting yoke member 56. The upper synchronizing wheels 38 are integral with the upper cam member 46 or affixed to the sides of the upper cam member so that the upper cam member 46 and the upper synchronizing wheels 38 pivot together. Each of the upper synchronizing wheels 38 and the lower synchronizing wheels 42 has a timing cable retainer for ensuring that a timing cable 72, used to synchronize the pivotal movements of the upper cam member 46 and the lower cam member 48 when the bow string 44 is drawn does not slip relative to the wheel when the cam members 46 and 48 pivot. While other timing cable retainers may be used on the synchronizing wheels, FIG. 3 shows a retaining pin 74 that passes through a pair of aligned holes 76 in the synchronizing wheel. To synchronize the pivotal movement of the upper and lower cam members 46 and 48, the timing cable 72 is wrapped about the upper and lower synchronizing wheels on the left or right sides of the upper and lower cam members and, as shown in FIGS. 1 and 2, crosses intermediate the upper and lower synchronizing wheels. As the timing cable 72 is wrapped about the upper and lower synchronizing wheels, the timing cable 72 is wrapped about the retaining pins 74 or otherwise secured to the synchronizing wheels to assure no slippage between the timing cable 72 and the synchronizing wheels occurs when the upper and lower cam members pivot. By crossing the timing cable 72 between the upper and lower synchronizing wheels of the cam synchronizing mechanism, when the bowstring 44 is drawn from the initial undrawn position shown in FIG. 2 to a drawn position shown in FIG. 1, the upper cam member 46 pivots clockwise to the position shown in FIG. 1 and the lower cam member 48 pivots in the opposite or counterclockwise direction to the same degree to the position shown in FIG. 1. When the bowstring 44 is released from the drawn position shown in FIG. 1, the synchronizing mechanism causes the synchronized pivotal movement of the upper and lower cam members 46 and 48 to their initial position shown in FIG. 2. By having synchronizing wheels of the cam synchronizing mechanism on both sides of the upper and lower cam members 46 and 48, the timing cable 72 can be located on either side of the cam members and out of the way of the archer to accommodate bow usage by right or left handed archers.

The rigid upper limb 24 and the rigid lower limb 26 are each tubular members that preferably have lateral flanges 78 and 80 that enhance the rigidity of the upper and lower limbs 24 and 26 and provide the upper and lower limbs 24 and 26 with an appearance more closely approximating that of a traditional archery bow. FIG. 4, which is a transverse cross section through the rigid upper limb 24, shows one configuration for the lateral flanges 78 of the rigid upper limb 24.

The rigid upper and lower limbs 24 and 26 each contain a separate coil spring tensioning assembly for applying tension to the bowstring 44 through the upper and lower cam assemblies 36 and 40. When the bowstring 44 is drawn, the bow poundage coil springs of the coil spring tensioning assemblies contained within the upper and lower limbs 24 and 26 are compressed and place the bowstring 44 under increasing tension as the bowstring is drawn. When the archer releases the bowstring 44, the bow poundage coil springs of the coil spring tensioning assemblies in the rigid upper and lower limbs 24 and 26 rapidly expand and snap the bowstring 44 rapidly back to its initial undrawn position to propel an arrow. The upper coil spring tensioning assembly 82 of the rigid upper limb 24 and the lower coil spring tensioning assembly (not shown) of the rigid lower limb 26 have the same structure and function in the same way. Accordingly, the following detailed description of a preferred embodiment of the upper coil spring tensioning assembly 82 and its interaction with the upper cam assembly 36 applies to the lower coil spring tensioning assembly and its interaction with the lower cam assembly 40.

The coil spring tensioning assembly 82 of the rigid upper limb 24 of the compound spring-loaded bow 20 includes: a tubular spring housing 84; a bow poundage compression coil spring 86; a spring compression member 88, a tensioning cable 90, and an adjustment mechanism 91 for adjusting the degree of pre-compression of the bow poundage coil spring 86. The tubular spring housing 84 contains the bow poundage compression coil spring 86 and the spring compression member 88. The tubular spring housing 84 is slidably housed within the rigid upper limb 24 of the bow and can be moved within the rigid upper limb 24 in a direction that coincides with the longitudinal axis of the rigid upper limb 24. The tubular spring housing 84 has a first end facing the cam assembly end of the rigid upper limb 24 and a second end that faces the riser end of the rigid upper limb. The spring compression member 88 is slidably housed within the tubular spring housing 84 and can be moved within the tubular spring housing 84 in a direction that coincides with the longitudinal axis of the tubular spring housing 84. The bow poundage compression coil spring 86 of the upper coil spring tensioning assembly 82 extends between and abuts a spring end abutment 92 at the first end of the tubular spring housing 84 and a spring end abutment 94 of the spring compression member 88. Preferably, the spring end abutment 92 of the tubular spring housing 84 is an end cap that is threaded into the first end of the tubular spring housing. Preferably, the spring compression member 88 is a tubular spring compression member; the spring end abutment 94 of the spring compression member is an end cap that is threaded into one end tubular spring compression member 88; and the spring compression member 88 partially houses the bow poundage compression coil spring 86 of the coil spring tensioning assembly 82. The tubular configuration of the spring compression member 88 facilitates a smooth sliding movement of the spring compression member relative to the tubular spring housing 84 and the tubular configuration of the tubular spring housing 84 facilitates a smooth sliding movement of the tubular spring housing 84 relative to the rigid upper limb 24.

When the compound spring-loaded archery bow 20 is strung, the bowstring 44 is strung between the upper and lower cam members 46 and 48 with a poundage being exerted on the bowstring, in its undrawn position, that is typically quite low but sufficient to make the bowstring 44 taut in this undrawn position. The tensioning cable 90 is attached at a first end to the retaining pin 70 of the upper cam member 46; at a second end to spring end abutment 94 of the spring compression member 88; and, intermediate its ends, the tensioning cable 90 passes slidably through the upper mounting yoke member, the spring end abutment 92 in the first end of the tubular spring housing 84, and the bow poundage coil spring 86. With this structure, as the bowstring 44 of the compound spring-loaded bow 20 is drawn (e.g. from the position shown in FIG. 5 to the position shown in FIG. 6), the bow poundage coil spring 86 of the upper coil spring tensioning assembly 82 is compressed by the spring compression member 88 and tension on the bowstring 44 is progressively increased as the bowstring is drawn. To enable the poundage of the compound spring-loaded archery bow 20 to be adjusted as described hereinafter without affecting the tension on the bowstring 44 in its undrawn position, when the bowstring 44 is in its undrawn position shown in FIG. 2, the cam stop 64 on the base of the upper cam member 46 abuts the cam stop surface 66 on the upper mounting yoke member 56 to limit the counterclockwise movement of the upper cam member 46.

The adjustment mechanism 91 of the upper coil spring tensioning assembly 82 for changing the degree of pre-compression of the bow poundage coil spring 86 of the upper coil spring tensioning assembly 82 is associated with the second end of the tubular spring housing 84 of the coil spring tensioning assembly 82. The degree of pre-compression of the bow poundage coil spring 86 is adjusted to raise or lower the forces exerted by the bow poundage coil spring 86 on the tensioning cable 90 and through the tensioning cable 90 and upper cam assembly 36, the forces exerted by the coil spring tensioning assembly 82 on the bowstring 44 that apply increasing tension to the bowstring 44 as the bowstring is drawn back from its initial undrawn position in the act of shooting an arrow. In a preferred embodiment of the subject invention, the adjustment mechanism of the upper coil spring tensioning assembly 82 includes an adjustment rod 96 that has an unthreaded portion rotatably held in a lower end cap 98 of the rigid upper limb 24. The adjustment rod 96 is retained in the end cap 98 and the end cap 98 is threaded into or otherwise affixed to the lower end of the rigid upper limb 24 so that the adjustment rod 96 does not move axially relative to the end cap 98 and the end cap 98 does not move relative to the lower end of the rigid upper limb 24 when the adjustment rod 96 is turned or rotated within the end cap 98. The adjustment rod 96 has a head 100 at one end that is exposed at the base of the socket 32 in the central riser 22 and slotted or otherwise configured so that the adjustment rod 96 can be turned with a screwdriver, Allen wrench, or similar tool. The other end of the adjustment rod 96 has a threaded portion that is threaded into a threaded hole in an end cap 102 in the second end of the tubular spring housing 84. The end cap 102 is threaded into or otherwise affixed to the second end of the tubular spring housing 84 so that when the adjustment rod 96 is turned, the tubular spring housing 84 is moved axially up or down within the rigid upper limb 24. The adjustment mechanism 91 has an assembly to assure that the tubular spring housing 84 does not rotate within the upper limb 24 when the adjustment rod 96 is turned. In the embodiment shown, this assembly is formed by a pair of retaining rods 104 that are each anchored or affixed at one end in the end cap 98 and are each slidably received at their other end portion in a hole 106 passing through the end cap 102 of the tubular spring housing 84. With this structure as the tubular spring housing 84 is moved axially within the upper limb 24 toward or away from the riser 22 by turning the adjustment rod 96, the retaining rods 104 slide within the holes 106 of the end cap 102 and keep the end cap and thus the tubular spring housing 84 from rotating with the adjustment rod 96. Since the bow poundage coil spring 86 has one end abutting the spring end abutment 92 at the first end of the tubular spring housing 84 and the other end abutting the spring end abutment 94 of the spring compression member 88, the axial movement of the tubular spring housing 84 within the rigid upper limb 24 changes the degree of pre-compression of the bow poundage coil spring 86 to raise or lower the forces exerted by the bow poundage coil spring 86 on the tensioning cable 90 and through the tensioning cable 90 and upper cam assembly 36, the forces exerted on the bowstring 44 by the coil spring tensioning assembly 82 that apply increasing tension to the bowstring 44 as the bowstring is drawn back from its initial undrawn position in the act of shooting an arrow.

Figure 7:
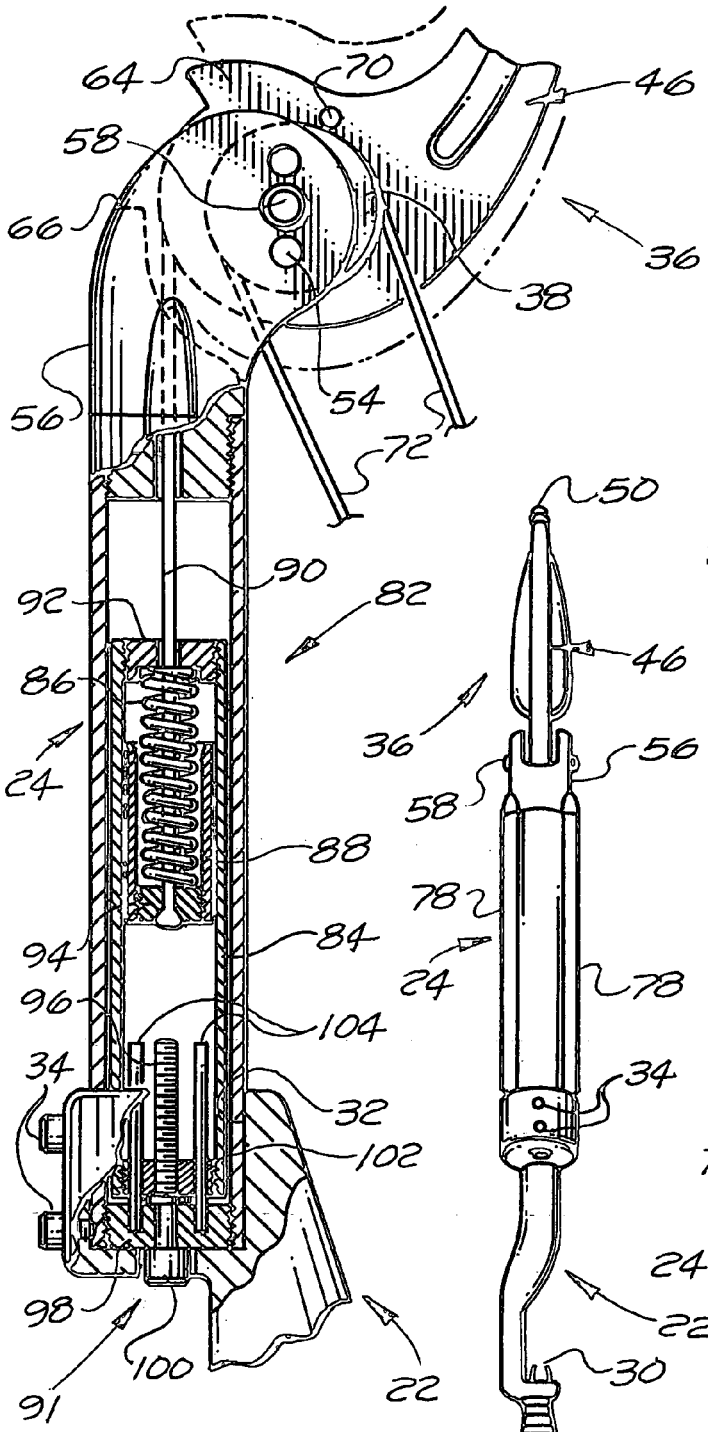
FIG. 7 is a vertical section of the rigid upper limb, the upper coil spring tensioning assembly, and the upper cam assembly of the compound spring-loaded archery bow of FIG. 1 with the bow poundage compression coil spring of the upper coil spring tensioning assembly precompressed to substantially the highest initial compression setting for the assembly and the compression coil spring of the coil spring tensioning assembly being further compressed as a result of the bowstring being fully or substantially fully drawn.
Figure 9:
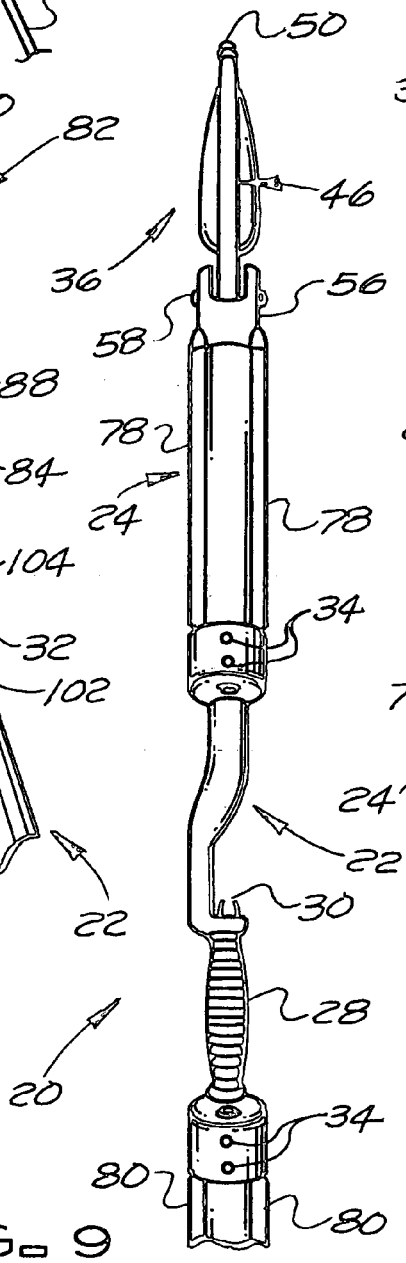
FIG. 9 is a partial front view in elevation of the upper end portion of the rigid upper limb and the upper cam assembly of the compound spring-loaded archery bow of FIG. 1.

FIGS. 5 and 6 show the bow poundage coil spring 86 pre-compressed to only a slight degree with the bowstring 44 in its undrawn position in FIG. 5 and in a drawn position in FIG. 6. FIG. 7 shows the bow poundage coil spring 86 pre-compressed to substantially a maximum degree with the bowstring 44 in a drawn position. With the pre-compression adjustment mechanism of the subject invention, the compound spring-loaded archery bow 20 can have a maximum drawing force set at any desired setting over a broad range, e.g. from a minimum of a 10 pound pull or less to a maximum of a 100 pound pull or greater.

While not shown, it is contemplated that the head 100 of the adjustment rod 96 of the adjustment mechanism 91 of the coil spring tensioning assembly 82 and the exposed surface of the riser 22 immediately surrounding the opening in the riser containing the head 100 of the adjustment rod 96 may have calibrations thereon, e.g. numbers or markings, so that degree of adjustment made by turning the adjustment rod 96 of the adjustment assembly can be precisely monitored and known. The same structure would be provided for the adjustment mechanism of the coil spring tensioning assembly of the lower limb 26. These structures would enable the degree of adjustment of the upper and lower adjustment mechanisms associated with the coil spring tensioning assemblies in the upper and lower limbs 24 and 26 to be accurately monitored for tuning the archery bow 20.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A compound spring-loaded archery bow comprising:

a rigid bow frame comprising a rigid central riser, a rigid upper limb, and a rigid lower limb;

the rigid central riser with a handgrip and an arrow rest; the central riser having an upper end portion and a lower end portion;

the rigid upper limb extending upward from the upper end portion of the central riser; the rigid lower limb extending downward from the lower end portion of the central riser;

an upper cam means mounted on an upper end portion of the rigid upper limb and a lower cam means mounted on a lower end portion of the rigid lower limb; a bowstring secured to extending between the upper and lower cam means which actuates the upper and lower cam means when the bowstring is drawn; the bowstring having an initial undrawn position;

the rigid upper limb being a tubular member and containing an upper spring assembly for applying tension to the bowstring through the upper cam means when the upper cam means is actuated by drawing the bowstring from the initial undrawn position; the upper spring assembly comprising an upper compression coil spring and an upper connector means connecting the upper compression spring to the upper cam means so that when the upper cam means is actuated by drawing the bowstring, the upper compression spring of the upper spring assembly is increasing compressed as the bowstring is drawn to exert forces of increasing magnitude on the bowstring to increase the tension in the bowstring; the upper cam means has a preset unactuated position where the upper spring assembly does not exert forces on the bowstring through the cam means;

the rigid lower limb being a tubular member and containing a lower spring assembly for applying tension to the bowstring through the lower cam means when the cam means is actuated by drawing the bowstring from the initial undrawn position; the lower spring assembly comprising a lower compression coil spring and a lower connector means connecting the lower compression spring to the lower cam means so that when the lower cam means is actuated by drawing the bowstring, the lower compression spring of the lower spring assembly is increasing compressed as the bowstring is drawn to exert forces of increasing magnitude on the bowstring to increase the tension in the bowstring; the lower cam means has a preset unactuated position where the lower spring assembly does not exert forces on the bowstring through the cam means; and synchronization means interconnecting the upper and lower cam means so that the upper and lower cam means are actuated to substantially the same degree when the bowstring is drawn from the initial undrawn position.

2. The compound spring-loaded archery bow according to claim 1, wherein:

the rigid bow frame of the compound spring-loaded archery bow consists essentially of the central riser, the upper limb, and the lower limb.

3. The compound spring-loaded archery bow according to claim 1, wherein:

the rigid upper limb and the rigid lower limb are each detachably secured to the central riser so that the compound spring-loaded archery bow can be disassembled when not in use for compact storage, handling, and transport.

4. The compound spring-loaded archery bow according to claim 1, including:

means for adjusting an initial compression of the upper compression spring of the upper spring assembly with the upper cam means in the unactuated position to adjust the magnitude of the forces exerted by the upper spring assembly through the upper cam means on the bowstring when the bowstring is drawn from the initial position and means for adjusting an initial compression of the lower compression spring of the lower spring assembly with the lower cam means in the unactuated position to adjust the magnitude of the forces exerted by the lower spring assembly through the lower cam means on the bowstring when the bowstring is drawn from the initial position whereby the magnitude and relative magnitude of the forces exerted on the bowstring by the upper spring assembly through the upper cam means and the lower spring assembly through the lower cam means can be adjusted to set a maximum drawing force for drawing the bowstring and forces of desired relative magnitude on the bowstring from the upper and lower spring assemblies for enhanced performance of the bow.

5. The compound spring-loaded archery bow according to claim 4, wherein:

the rigid bow frame of the compound spring-loaded archery bow consists essentially of the central riser, the upper limb, and the lower limb.

6. The compound spring-loaded archery bow according to clam 4, wherein:

the rigid upper limb and the rigid lower limb are each detachably secured to the central riser so that the compound spring-loaded archery bow can be disassembled when not in use for compact storage, handling, and transport.

7. The compound spring-loaded archery bow according to claim 1, wherein:

the upper spring assembly comprises an upper tubular spring housing that houses the upper compression spring and an upper spring compression member; the upper tubular spring housing is slidably housed within the rigid upper limb, can be moved within the rigid upper limb in a direction that coincides with a longitudinal axis of the rigid upper limb, and has an upper end against which an upper end of the upper compression spring abuts; the upper spring compression member is slidably housed within the upper tubular spring housing, can be moved within the upper tubular spring housing in a direction which coincides with a longitudinal axis of the upper tubular spring housing, and engages a lower end of the upper compression spring; and the upper spring compression member is connected to the upper cam means by the upper connector means whereby when the upper cam means is actuated by drawing the bowstring from the initial undrawn position the upper spring compression member is drawn toward the upper end of the upper tubular spring housing to compress the upper compression spring and when the bowstring is loosed the upper compression spring rapidly expands to an initial length to snap the bowstring back to the initial undrawn position; and the lower spring assembly comprises a lower tubular spring housing that houses the lower compression spring and a lower spring compression member; the lower tubular spring housing is slidably housed within the rigid lower limb, can be moved within the rigid lower limb in a direction that coincides with a longitudinal axis of the rigid lower limb, and has an lower end against which a lower end of the lower compression spring abuts; the lower spring compression member is slidably housed within the lower tubular spring housing, can be moved within the lower tubular spring housing in a direction which coincides with a longitudinal axis of the lower tubular spring housing, and engages an upper end of the lower compression spring; and the lower spring compression member is connected to the lower cam means by the lower connector means whereby when the lower cam means is actuated by drawing the bowstring from the initial undrawn position the lower spring compression member is drawn toward the lower end of the lower tubular spring housing to compress the lower compression spring and when the bowstring is loosed the lower compression spring rapidly expands to an initial length to snap the bowstring back to the initial undrawn position.

8. The compound spring-loaded archery bow according to claim 7, wherein:

the rigid bow frame of the compound spring-loaded archery bow consists essentially of the central riser, the upper limb, and the lower limb.

9. The compound spring-loaded archery bow according to claim 7, wherein:

the rigid upper limb and the rigid lower limb are each detachably secured to the central riser so that the compound spring-loaded archery bow can be disassembled when not in use for compact storage, handling, and transport.

10. The compound spring-loaded archery bow according to claim 7, including:

means for adjusting an initial compression of the upper compression spring of the upper spring assembly with the upper cam means in the unactuated position to adjust the magnitude of the forces exerted by the upper spring assembly through the upper cam means on the bowstring when the bowstring is drawn from the initial position and means for adjusting an initial compression of the lower compression spring of the lower spring assembly with the lower cam means in the unactuated position to adjust the magnitude of the forces exerted by the lower spring assembly through the lower cam means on the bowstring when the bowstring is drawn from the initial position whereby the magnitude and relative magnitude of the forces exerted on the bowstring by the upper spring assembly through the upper cam means and the lower spring assembly through the lower cam means can be adjusted to set a maximum drawing force for drawing the bowstring and forces of desired relative magnitude on the bowstring from the upper and lower spring assemblies for enhanced performance of the bow.

11. The compound spring-loaded archery bow according to claim 10, wherein:

the rigid bow frame of the compound spring-loaded archery bow consists essentially of the central riser, the upper limb, and the lower limb.

12. The compound spring-loaded archery bow according to clam 10, wherein:

the rigid upper limb and the rigid lower limb are each detachably secured to the central riser so that the compound spring-loaded archery bow can be disassembled when not in use for compact storage, handling, and transport.

13. The compound spring-loaded archery bow according to claim 10, wherein:

the means for adjusting an initial compression of the upper compression spring of the upper spring assembly with the upper cam means in the unactuated position comprises means for moving the upper tubular spring housing along the longitudinal axis of rigid upper limb to move the upper end of the upper tubular spring housing toward or away from the upper spring compression member and thereby adjust the distance between the upper end of the upper tubular spring housing and the upper spring compression member and the initial compression of the upper compression spring; and the means for adjusting an initial compression of the lower compression spring of the lower spring assembly with the lower cam means in the unactuated position comprises means for moving the lower tubular spring housing along the longitudinal axis of rigid lower limb to move the lower end of the lower tubular spring housing toward or away from the lower spring compression member and thereby adjust the distance between the lower end of the lower tubular spring housing and the lower spring compression member and the initial compression of the lower compression spring.

14. The compound spring-loaded archery bow according to claim 13, wherein:

the means for moving the upper tubular spring housing along the longitudinal axis of rigid upper limb to move the upper end of the upper tubular spring housing toward or away from the upper spring compression member comprises an upper threaded rod rotatably held in a lower end of the rigid upper limb and threaded into a lower end of the upper tubular spring housing so that when the upper threaded rod is rotated the upper tubular spring housing moves axially within the rigid upper limb; and the means for moving the lower tubular spring housing along the longitudinal axis of rigid lower limb to move the lower end of the lower tubular spring housing toward or away from the lower spring compression member comprises a lower threaded rod rotatably held in an upper end of the rigid lower limb and threaded into an upper end of the lower tubular spring housing so that when the lower threaded rod is rotated the lower tubular spring housing moves axially within the rigid lower limb.

15. The compound spring-loaded archery bow according to claim 13, wherein:

the upper spring compression member is a tubular compression member that has an upper compression spring abutting surface at a lower end and houses a lower portion of the upper compression spring; and the lower spring compression member is a tubular compression member that has a lower compression spring abutting surface at an upper end and houses an upper portion of the lower compression spring.

16. The compound spring-loaded archery bow according to claim 1, wherein:

the upper cam means includes an upper cam member with a lever arm to which an upper end of the bowstring is attached;

the lower cam means includes a lower cam member with a lever arm to which a lower end of the bowstring is attached; and the synchronizing means comprises an upper wheel that pivots with the upper cam member; a lower wheel that pivots with the lower cam member; and a timing cable wrapped about the upper wheel and the lower wheel that crosses intermediate the upper wheel and the lower wheel whereby when the bowstring is drawn from the initial undrawn position and the upper wheel pivots with the upper cam member, the lower wheel pivots with the lower cam member, and the upper and lower cam members are actuated to substantially the same degree.

17. The compound spring-loaded archery bow according to claim 1, wherein:

the upper cam means includes an upper cam member with a lever arm to which an upper end of the bowstring is attached;

the lower cam means includes a lower cam member with a lever arm to which a lower end of the bowstring is attached; and the synchronizing means comprises a first upper wheel on a first side of the upper cam member that pivots with the upper cam member, a second upper wheel on a second side of the upper cam member that pivots with the upper cam member; a first lower wheel on a first side of the lower cam member that pivots with the lower cam member, a second lower wheel on a second side of the lower cam member that pivots with the lower cam member, and a timing cable wrapped about the one of the upper wheels and one of the lower wheels that crosses intermediate the upper and the lower wheels about which the timing cable is wrapped whereby when the bowstring is drawn from the initial undrawn position and the upper wheel about which the timing cable is wrapped pivots with the upper cam member, the lower wheel about which the timing cable is wrapped pivots with the lower cam member, and the upper and lower cam members are actuated to substantially the same degree.

* * * * *